US007410162B2

(12) United States Patent
Takasaka et al.

(10) Patent No.: US 7,410,162 B2
(45) Date of Patent: Aug. 12, 2008

(54) IMAGE FORMING APPARATUS

(75) Inventors: Daisuke Takasaka, Higashiosaka (JP); Koichi Chikumoto, Osaka (JP); Daisuke Shimizu, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 405 days.

(21) Appl. No.: 11/217,335

(22) Filed: Sep. 2, 2005

(65) Prior Publication Data

US 2006/0071402 A1 Apr. 6, 2006

(30) Foreign Application Priority Data

Sep. 9, 2004 (JP) ..... 2004-262559

(51) Int. Cl.
*B65H 1/10* (2006.01)
*B65H 1/12* (2006.01)

(52) U.S. Cl. ..... 271/160; 271/147; 271/128; 271/157; 271/127; 271/22; 271/24; 271/162; 16/357; 16/358; 347/215; 347/216; 347/218

(58) Field of Classification Search ..... 271/160, 271/147, 152, 157, 127, 22, 24, 30.1, 128, 271/162; 16/357, 358; 347/216, 215, 218
See application file for complete search history.

(56) References Cited

U.S. PATENT DOCUMENTS 4,106,763 A * 8/1978 Tani et al. ..... 271/9.01
4,350,328 A * 9/1982 Katakura et al. ..... 271/22
4,623,137 A * 11/1986 Irie et al. ..... 271/160
4,728,094 A * 3/1988 Yoshida ..... 271/119
4,828,245 A * 5/1989 Shimogawara ..... 271/171
5,419,645 A * 5/1995 Russo ..... 400/624
5,615,873 A * 4/1997 Kobayashi et al. ..... 271/121
5,775,686 A * 7/1998 Miyake ..... 271/127
6,149,147 A * 11/2000 Hur et al. ..... 271/160
6,354,584 B1 * 3/2002 Suga et al. ..... 271/10.12
2002/0158962 A1 * 10/2002 Ishikawa ..... 347/215
2007/0273082 A1 * 11/2007 Sawai ..... 271/147

FOREIGN PATENT DOCUMENTS

JP 60-69238 U 5/1985
JP 09-309629 A 12/1997

* cited by examiner

*Primary Examiner*—Patrick Mackey
*Assistant Examiner*—Prasad V Gokhale
(74) *Attorney, Agent, or Firm*—Global IP Counselors, LLP

(57) ABSTRACT

An image forming apparatus has a chassis, a paper feed roller, a lifting member, and a biasing member. The chassis has a first side surface, a second side surface, and a bottom surface that connects the first and second side surfaces. The bottom surface has one of a first L-shaped projecting portion and a first coupling hole unitarily formed thereon. The paper feed roller is rotatably supported by the first and second side surfaces of the chassis and configured to convey paper. The lifting member is pivotably supported by the bottom surface of the chassis, and has a main portion and the other of the first L-shaped projecting portion and the first coupling hole unitarily formed on the main portion. The first L-shaped projection is pivotably coupled to the first coupling hole, such that the lifting member is pivotably coupled to the bottom surface.

10 Claims, 10 Drawing Sheets

PRIOR ART

IMAGE FORMING APPARATUS

BACKGROUND OF THE INVENTION

1. Field of the Invention

The present invention relates to an image forming apparatus. More particularly, the present invention relates to an image forming apparatus equipped with a paper feed mechanism for feeding paper.

2. Background Information

A thermal transfer printer is a known example of a conventional image forming apparatus equipped with a paper feed mechanism for feeding paper. Such paper feed mechanism of the thermal transfer printer generally has a paper feed roller for feeding paper, and a lifting member for pressing the paper against the paper feed roller. The lifting member is pivotably supported by side surfaces of a chassis, and is biased upward by a coil spring that is disposed underneath the lifting member.

As shown in FIG. 15, the lifting member 109 has two insertion holes 109*a*, an attaching part 109*b*, and a pressing part 109*c*. The lifting member 109 is pivotably supported by the side surfaces of the chassis at the two insertion holes 109*a*.

As shown in FIG. 17, the attaching part 109*b* of the lifting member 109 is formed so as to engage a cam component 111*a* of a drive gear 111 with the biasing force of the compression coil spring 110. This compression coil spring 110 is disposed underneath and close to the pressing part 109*c*. Also, as shown in FIG. 16, the pressing part 109*c* of the lifting member 109 is disposed underneath a pressing plate 106*a* of the paper cassette 106.

The drive gear 111 is attached to the side surface of the chassis. A cam component 111*a* that engages the attaching part 109*b* of the lifting member 109 is provided to this drive gear 111. On this cam component 111*a* are formed a circular part 111*b* and a concave part 111*c*.

The pressing plate 106*a* is provided in the paper cassette 106. This pressing plate 106*a* is formed to pivot around a fulcrum 106*b*. Also, as shown in FIG. 17, the pressing plate 106*a* is formed so as to press the paper 122 against the paper feed roller 102 when the pressing part 109*c* of the lifting member 109 is pushed up.

As seen in FIG. 16, the paper feed roller 102 is disposed above the pressing plate 106*a* of the paper cassette 106. Also, the paper feed roller 102 is designed so as to convey the paper in the paper feed direction (the direction of the arrow G in FIG. 17) when rotated.

Next, how paper is fed in a conventional thermal transfer printer will be described through reference to FIGS. 16, and 17. First, as shown in FIG. 16, the drive force from a motor causes the drive gear 111 to rotate in the direction of the arrow L in FIGS. 16 and 17. As a result, as shown in FIG. 16, the attaching part 109*b* of the lifting member 109 pivots from a state of being in contact with the circular part 111*b* of the drive gear 111 to a state of being in contact with the concave part 111*c* of the drive gear 111, as shown in FIG. 17.

Accordingly, as shown in FIG. 17, the lifting member 109 pivots around the insertion holes 109*a* in the direction of the arrow I shown in FIGS. 16 and 17, due to the biasing force of the compression coil spring 110. As a result, the pressing part 109*c* of the lifting member 109 causes the paper 122 supported by the pressing plate 106*a* of the paper cassette 106 to be pressed against the paper feed roller 102. Then, the drive force of the motor is transmitted to the paper feed roller 102, such that the paper 122 is conveyed in the direction of the arrow G.

However, with the conventional thermal transfer printer shown in FIGS. 15 to 17, because the lifting member 109 is pivotably supported by the side surfaces of the chassis, the length of the lifting member 109 is the same as the distance between the side surfaces of the chassis. Thus, the lifting member 109 is quite large, and cannot be made smaller.

In view of the above, it will be apparent to those skilled in the art from this disclosure that there exists a need for an improved image forming apparatus that overcomes the problems of the related art. This invention addresses this need in the art as well as other needs, which will become apparent to those skilled in the art from this disclosure.

SUMMARY OF THE INVENTION

It is an object of this invention to provide an image forming apparatus in which a lifting member can be made more compact without having to increase the number of requisite components.

The image forming apparatus pertaining to the first aspect of the present invention includes a chassis having a first side surface, a second side surface, and a bottom surface that connects the first and the second side surfaces, the bottom surface having one of a first L-shaped projecting portion and a first coupling hole unitarily formed thereon; a paper feed roller that is rotatably supported by the first and second side surfaces of the chassis and configured to convey paper; a lifting member pivotably supported by the bottom surface of the chassis, and having a main portion and the other of the first L-shaped projecting portion and the first coupling hole unitarily formed on the main portion, the first L-shaped projecting portion being pivotably coupled to the first coupling hole, such that the lifting member is pivotably coupled to the bottom surface; and a biasing member for biasing the lifting member upward toward the paper feed roller.

With this image forming apparatus pertaining to this second aspect, as discussed above, because the L-shaped projecting portion is formed unitarily with the lifting member or the bottom surface, fewer parts are required as compared with the case where the pivoting shaft and the lifting member are formed separately. Also, since the L-shaped projecting portion is provided to the lifting member or the bottom surface, the L-shaped projecting portion prevents the lifting member from coming off upward through the coupling hole while the lifting member is being pivoted.

Also, the lifting member is fitted into the bottom surface of the chassis with the L-shaped projecting portion, and the coupling hole for pivotably supporting the lifting member is provided to the bottom surface of the chassis or the lifting member. Therefore, fewer parts are required as compared with the case where a member for pivotably supporting the lifting member is provided separately from the chassis. Furthermore, there is no need for the length of the lifting member to be the same as the distance between the two side surfaces of the chassis, unlike the case where a support shaft component that pivotably supports the lifting member is provided to the two side surfaces of the chassis. Therefore, the length of the lifting member can be shorter than the distance between the two side surfaces of the chassis. This allows the lifting member to be made smaller.

In the image forming apparatus pertaining to the second aspect, the first coupling hole is an L-shaped hole having a first paper conveyance direction width and a second paper conveyance direction width that is narrower than the first paper conveyance direction width. With this constitution, the wider portion of the coupling hole facilitates the attachment of the L-shaped projecting portion into the coupling hole, and the narrower portion of the coupling hole allows the L-shaped projecting portion to be easily supported so as to be pivotable.

The image forming apparatus pertaining to the third aspect of the present invention further includes a motor; a gear to which driving force of the motor is transmitted; and a cam portion that is relatively unrotatably attached to the gear. The lifting member has an engagement projection that engages the cam portion. With this constitution, the L-shaped projecting portion can be prevented from moving relative to the coupling hole horizontally, so the lifting member can be more effectively prevented from coming off upward through the joining hole.

In the image forming apparatus pertaining to the fourth aspect of the present invention, the gear is coupled to the first side surface of the chassis, and the engagement projection of the lifting member and the cam portion are sandwiched between the gear and the first side surface of the chassis.

In the image forming apparatus pertaining to the fifth aspect of the present invention, the bottom surface has first and second coupling holes formed thereon, and the lifting member has first and second L-shaped projecting portions formed on the main portion, the second L-shaped projecting portion being pivotably coupled to the second L-shaped coupling hole of the bottom surface, such that the lifting member is pivotably coupled to the bottom surface.

With this constitution, since the lifting member is pivotably supported by the two (first and second) coupling holes, the lifting member is able to pivot more stably.

In the image forming apparatus pertaining to the sixth aspect of the present invention, the first paper conveyance direction width of the first L-shaped coupling hole is wider than a paper conveyance direction width of the first L-shaped projecting portion of the lifting member.

The image forming apparatus pertaining to the sixth aspect of the present invention further includes a thermal head pivotably supported by the first and second side surfaces of the chassis and configured to be pivoted by the motor; and a platen roller rotatably supported by the first and second side surfaces of the chassis opposite the thermal head, printing being configured to be performed on paper when the paper is pressed against the platen roller by the thermal head. The lifting member is configured to be lifted up when the motor drives the thermal head to be pressed against the platen roller.

In the image forming apparatus pertaining to the eighth aspect of the present invention, the biasing member is an extension coil spring that is attached to one of the first and second side surfaces and the lifting member.

In the image forming apparatus pertaining to the ninth aspect of the present invention, the biasing member is a compression coil spring that is attached to the bottom surface underneath the lifting member.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Embodiments of the present invention will now be described through reference to the drawings.

Figure 1:
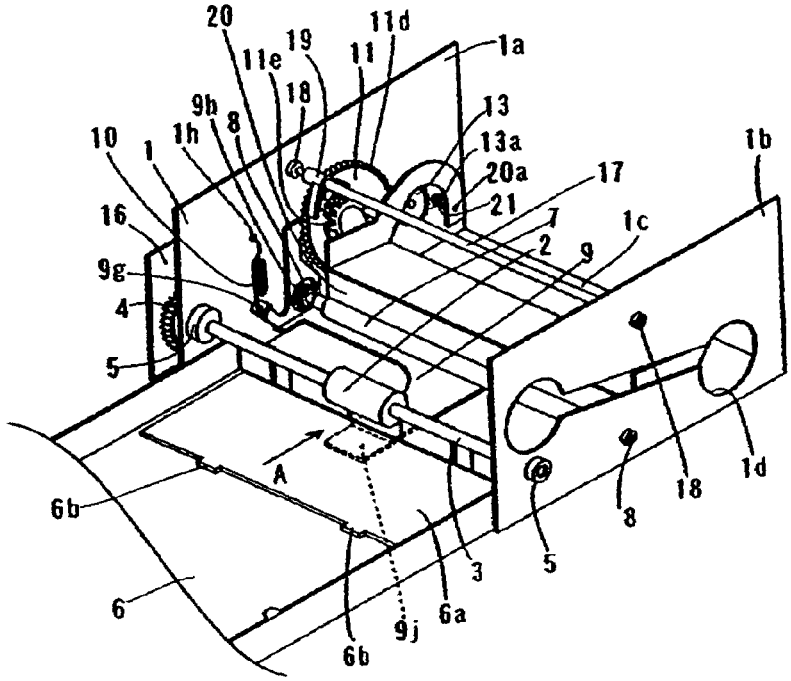
FIG. 1 is a perspective view of the overall structure of a thermal transfer printer pertaining to an embodiment of the present invention.
Figure 2:
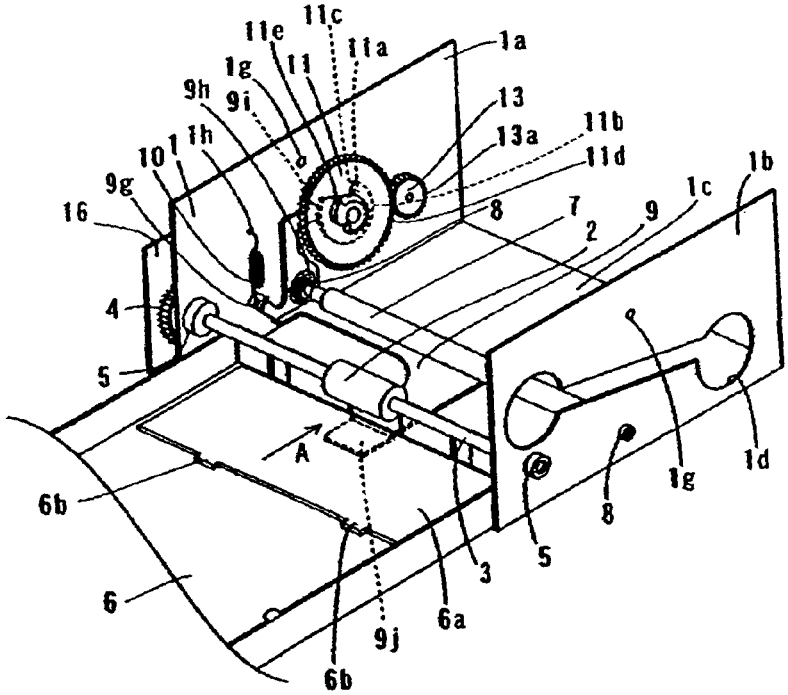
FIG. 2 is a perspective view of the thermal transfer printer pertaining to the embodiment shown in FIG. 1 without the thermal head and the support rod.
Figure 3:
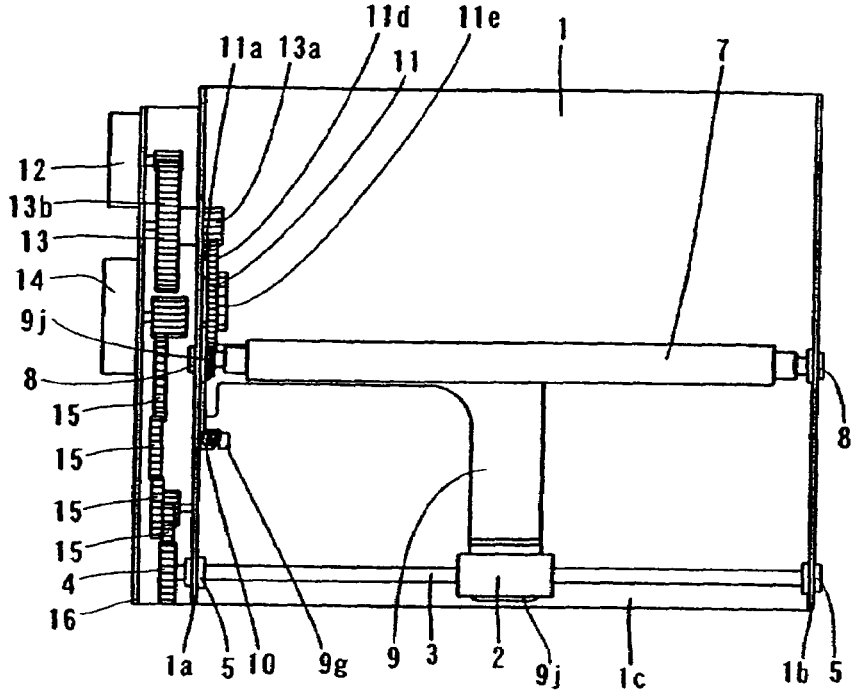
FIG. 3 is a schematic plan view of the thermal transfer printer pertaining to the embodiment shown in FIG. 1 without the thermal head and the support rod.

FIG. 1 is an oblique view of the overall structure of a thermal transfer printer pertaining to an embodiment of the present invention. FIG. 2 is an oblique view of the detailed structure of the thermal transfer printer pertaining to the embodiment shown in FIG. 1. FIG. 3 is a plan view of the thermal transfer printer pertaining to the embodiment shown in FIG. 1. FIGS. 4 to 11 are diagrams illustrating the detailed structure of the thermal transfer printer pertaining to the embodiment shown in FIG. 1. The structure of the thermal transfer printer pertaining to an embodiment of the present invention will be described through reference to FIGS. 1 to 11. In this embodiment, a thermal transfer printer will be described as an example of the image forming apparatus of the present invention.

Figure 9:
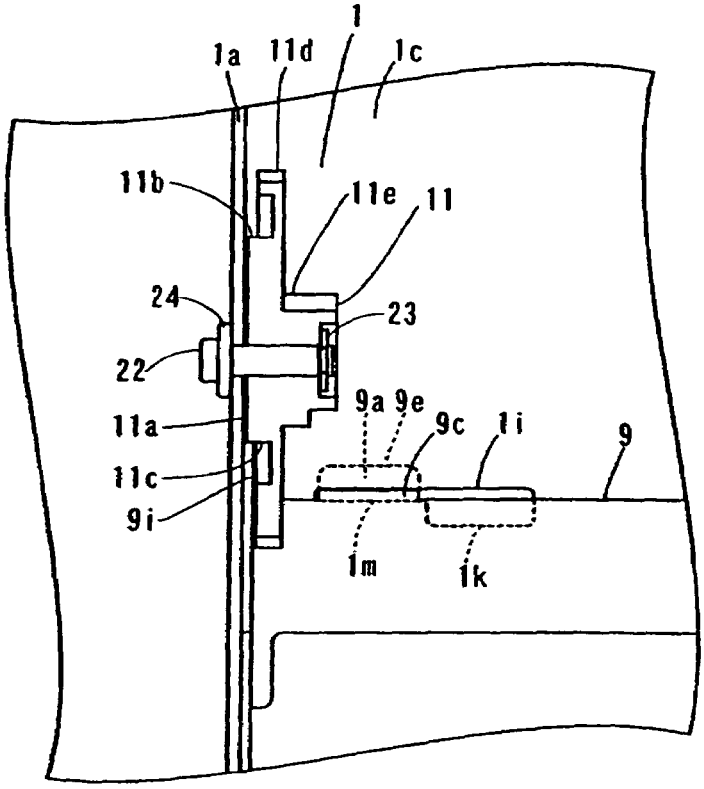
FIG. 9 is a partial schematic plan view of the detailed structure of the lifting member, the gear, and the chassis of the thermal transfer printer pertaining to the embodiment shown in FIG. 1.

As shown in FIGS. 1 to 3 and FIG. 9, the thermal transfer printer pertaining to an embodiment of the present invention includes a sheet metal chassis 1, a rubber paper feed roller 2 for feeding paper, a paper feed roller shaft 3 to which the paper feed roller 2 is coupled, a paper feed roller gear 4 for rotating the paper feed roller shaft 3, paper feed roller bearings 5, a plastic paper cassette 6 removably attached to the chassis for holding paper, a platen roller 7 against which the paper is pressed during the printing operation, platen roller bearings 8, a metal (sheet metal) lifting member 9 for pressing the paper against the paper feed roller 2, an extension coil spring 10 for biasing the lifting member 9 upward, a drive gear 11, a motor 12 (see FIG. 3) that functions as a drive source for driving the drive gear 11, an intermediate gear 13 (see FIG. 3) for transmitting the drive force from the motor 12 to the drive gear 11, a motor 14 (see FIG. 3) that functions as a drive source for rotating the paper feed roller 2, a plurality of intermediate gears 15 (see FIG. 3) for transmitting the drive force from the motor 14 to the paper feed roller gear 4, a metal motor bracket 16 to which the motor 12 and the motor 14 are attached, a support rod 17, support rod bearings 18, a pressing member 19, a thermal head 20, a torsion coil spring 21 for biasing the thermal head 20 away from the platen roller 7, a gear support shaft 22 for supporting the drive gear 11 (see FIG. 9), a lock washer 23 for securing the drive gear 11 to the gear support shaft 22 (see FIG. 9), and a washer 24 (see FIG. 9). The drive gear 11 is an example of the "gear" of the present invention.

As shown in FIG. 2, the chassis 1 has one side surface 1*a* to which the motor bracket 16 is attached, another side surface 1*b*, and a bottom surface 1*c* that connects the first side surface 1*a* and the second side surface 1*b*. An ink sheet case insertion hole 1*d* through which an ink sheet case (not shown) containing an ink sheet is inserted is provided to the side surface 1*b* of the chassis 1.

Figure 5:
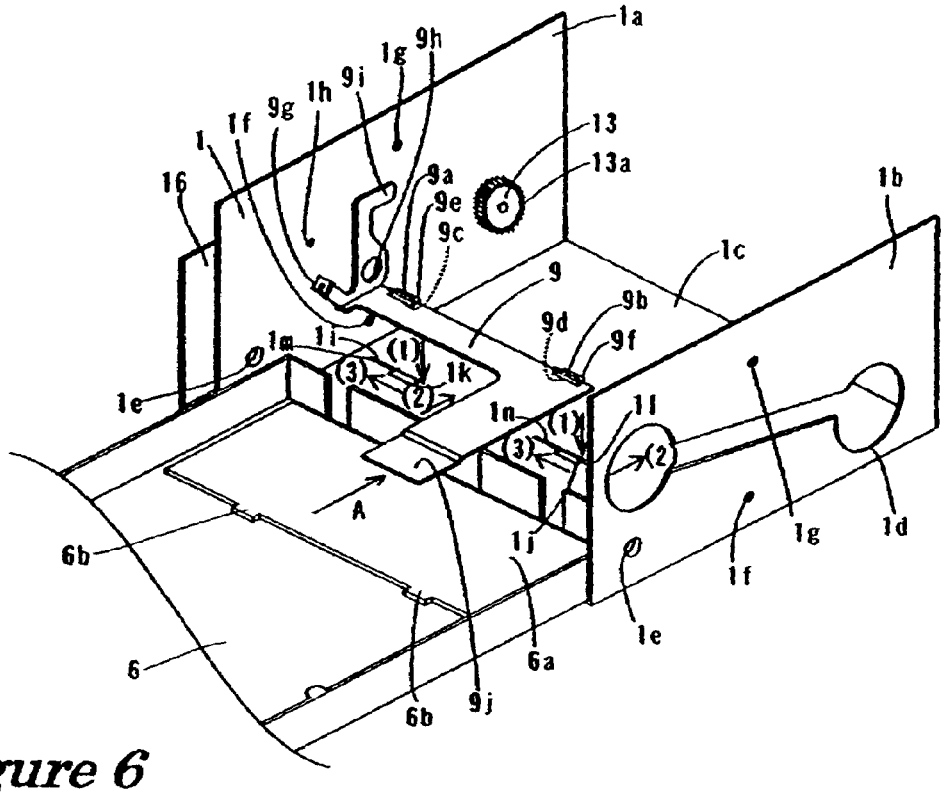
FIG. 5 is an exploded perspective view of the attachment structure of the lifting member, the paper cassette, and the chassis of the thermal transfer printer pertaining to the embodiment shown in FIG. 1.

Furthermore, as shown in FIG. 5, paper feed roller bearing attachment holes 1*e* for attaching the paper feed roller bearings 5, platen roller bearing attachment holes 1*f* for attaching the platen roller bearings 8, and bearing attachment holes 1*g* for attaching the support rod bearings 18 are provided to the side surface 1*a* and the side surface 1*b* of the chassis 1. The platen roller bearings 8 that rotatably support the ends of the platen roller 7 are attached to the platen roller bearing attachment holes 1*f* on the side surface 1*a* and the side surface 1*b* of the chassis 1. Also, as shown in FIG. 1, a spring attachment hole 1*h* for attaching one end of the extension coil spring 10 is provided to the side surface 1*a* of the chassis 1.

Figure 6:
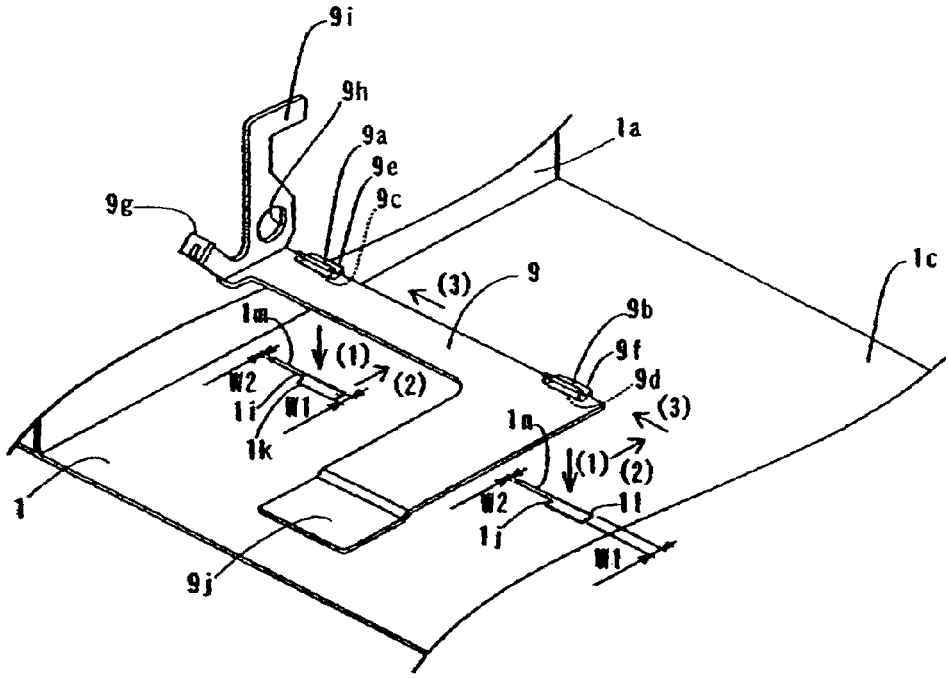
FIG. 6 is an exploded perspective view of the attachment structure of the lifting member and the bottom surface of the chassis of the thermal transfer printer pertaining to the embodiment shown in FIG. 1.

With this embodiment, as shown in FIG. 6, a coupling hole 1*i* into which a pivoting shaft part 9*a* of the lifting member 9 is fitted is provided in the bottom surface 1*c* of the chassis 1. Similarly, coupling hole 1*j* into which a pivoting shaft part 9*b* of the lifting member 9 is fitted is provided in the bottom surface 1*c* of the chassis 1. The coupling holes 1*i* and 1*j* are provided a predetermined distance apart.

The coupling hole 1*i* is a L-shaped hole with a slot-shaped coupling part 1*k* having a predetermined paper conveyance direction width W1, as well as with a slot-shaped support shaft part 1*m* having a width W2, which is narrower than the width W1 of the coupling part 1*k*. The support shaft part 1*m* is formed so as to be linked to the coupling part 1*k*. The pivoting shaft part 9*a* of the lifting member 9 is to be first inserted into the coupling part 1*k*, and slid to be coupled to the support shaft part 1*m*, as described in more detail below.

Similarly, the coupling hole 1*j* is a L-shaped hole with a slot-shaped coupling part 11 having a predetermined paper conveyance direction width W1, as well as with a slot-shaped support shaft part in having a width W2, which is narrower than the width W1 of the coupling part 11. The support shaft part in is formed so as to be linked to the coupling part 11. The pivoting shaft part 9*b* of the lifting member 9 is to be first inserted into the coupling part 11, and slid to be coupled to the support shaft part 1*n*.

Figure 7:
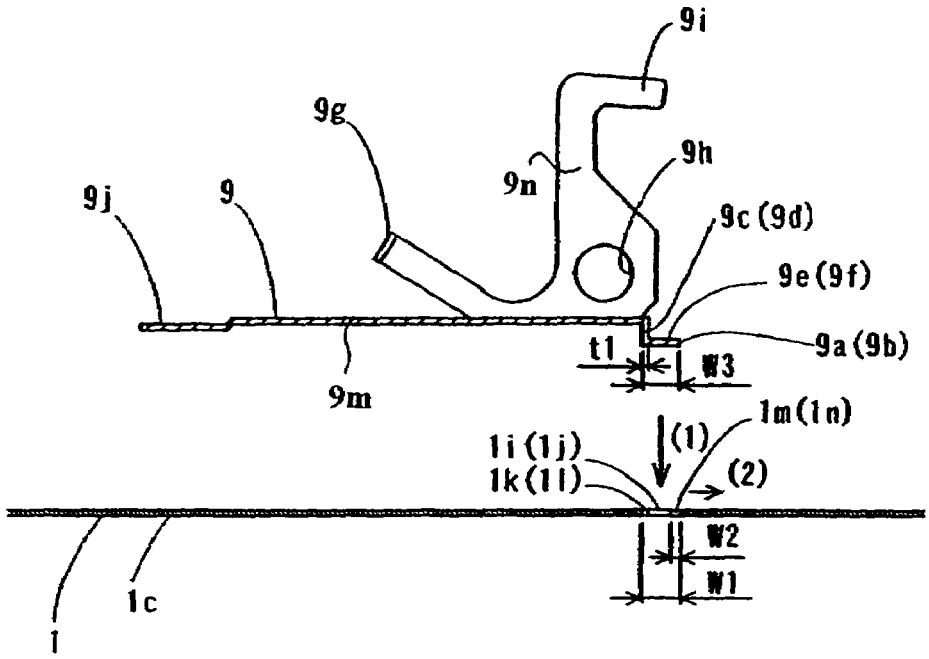
FIG. 7 is a schematic side view of the detailed structure of the lifting member of the thermal transfer printer pertaining to the embodiment shown in FIG. 1.

As shown in FIG. 7, the width W1 of the coupling parts 1*k* and 1*l* of the coupling holes 1*i* and 1*j* is greater than the width W3 of the pivoting shaft parts 9*a* and 9*b*. As a result, the pivoting shaft parts 9*a* and 9*b* can be fitted vertically downward into the coupling parts 1*k* and 1*l* from above, in a horizontal state, without having to tilt the lifting member 9. Also, the width W2 of the support shaft parts 1*m* and in of the coupling holes 1*i* and 1*k* is greater than the thickness t1 of the lifting member 9. Furthermore, as shown in FIG. 6, the coupling holes 1*i* and 1*j* pivotably support the lifting member 9 around the pivoting shaft parts 9*a* and 9*b*.

The coupling hole 1*i* is an example of the "first coupling hole" of the present invention, and the coupling hole 1*j* is an example of the "second coupling hole" of the present invention. The pivoting shaft part 9*a* is an example of the "first pivoting shaft part" of the present invention, and the pivoting shaft part 9*b* is an example of the "second pivoting shaft part" of the present invention.

Figure 4:
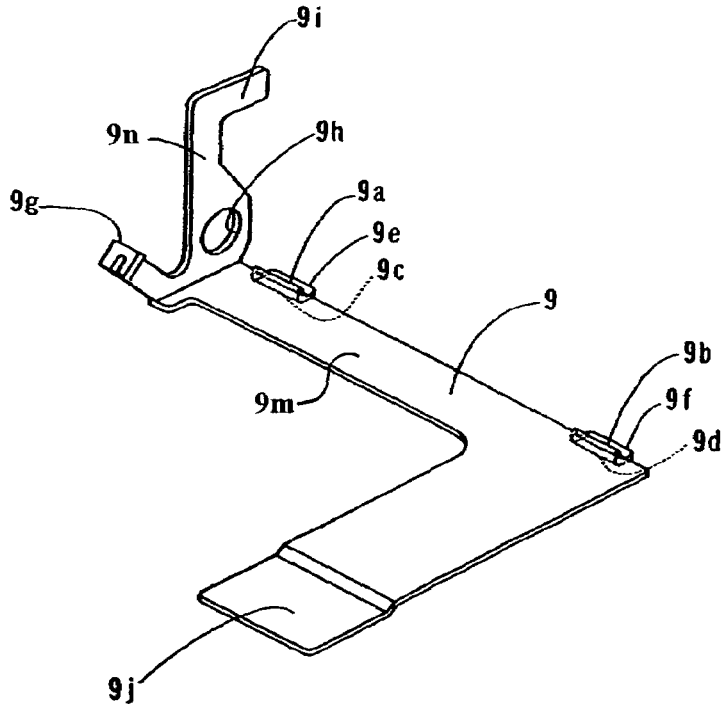
FIG. 4 is a perspective view of the lifting member of the thermal transfer printer pertaining to the embodiment shown in FIG. 1.

In this embodiment, as shown in FIG. 4, the metal-made lifting member 9 includes a main portion 9*m* having an L-shape, an upper portion 9*n* that extends upward from an end of the main portion 9*m*. The pivoting shaft part 9*a* and pivoting shaft part 9*b* are L-shaped projecting portions that are unitarily formed a specific distance apart on the main body 9*m*.

As shown in FIG. 7, the pivoting shaft part 9*a* includes a shaft portion 9*c* and a retainer portion 9*e*, which is for preventing the lifting member 9 from coming off upward. Similarly, the pivoting shaft part 9*b* includes a shaft portion 9*d* and a retainer portion 9*f*, which is for preventing the lifting member 9 from coming off upward. The shaft portions 9*c* and 9*d* are formed so as to be bent at a substantially right angle relative to the surface of the main portion 9*m* of the lifting member 9. The retainer portions 9*e* and 9*f* are bent at a substantially right angle relative to the surface of the shaft portions 9*c* and 9*d*, and extend substantially in parallel with the surface of the main portion 9*m* of lifting member 9 in a direction away from the main portion 9*m* of the lifting member 9.

Figure 10:
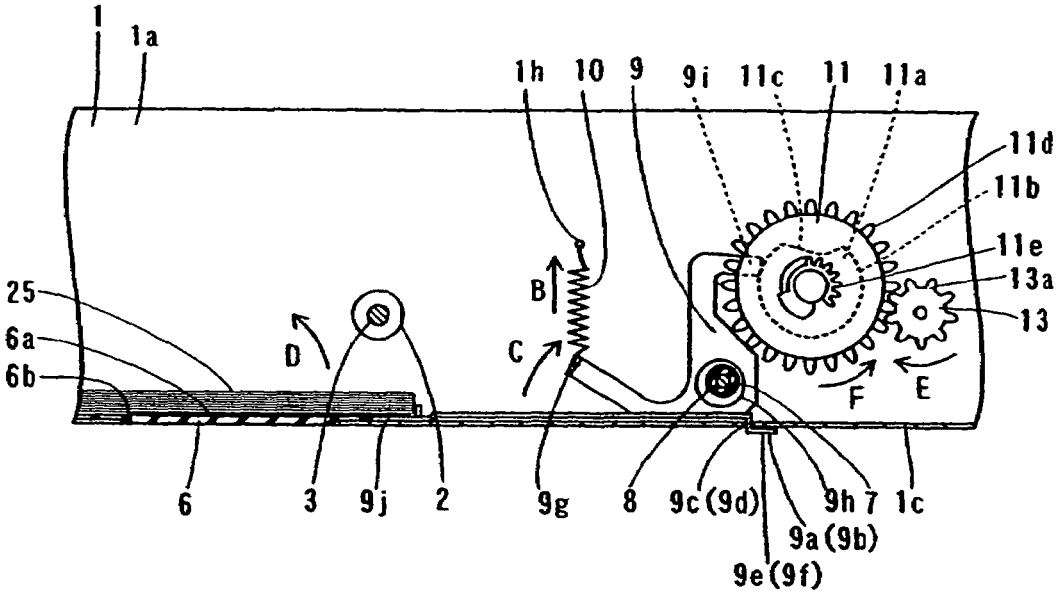
FIG. 10 is a schematic side view of the thermal transfer printer pertaining to the embodiment shown in FIG. 1 in a state when the engaging portion of the lifting member engages the circular portion of the cam component of the drive gear.
Figure 11:
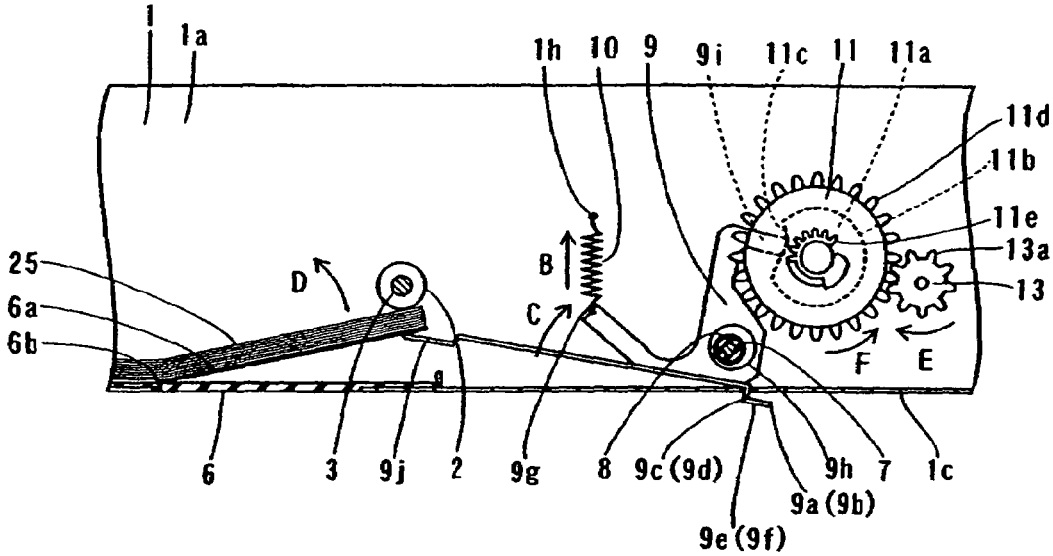
FIG. 11 is a schematic side view of the thermal transfer printer pertaining to the embodiment shown in FIG. 1 in a state when the engaging portion of the lifting member engages the concave portion of the cam component of the drive gear.

As shown in FIGS. 3, 10, and 11, the drive gear 11 has, on a side closer to the side surface 1*a*, a cam portion 11*a* for pivoting the lifting member 9. An engaging portion 9*i*, which engages with the cam portion 11*a* of the drive gear 11 as shown in FIG. 2, is formed unitarily with the upper portion 9*n* of the lifting member 9, as shown in FIG. 4. The engaging portion 9*i* of the lifting member 9 is sandwiched horizontally between the drive gear 11 and the first side surface 1*a* of the chassis 1.

Furthermore, as shown in FIG. 4, the lifting member 9 has an insertion hole 9*h* formed in the upper portion 9*n*. As shown in FIGS. 10 and 11, the insertion hole 9*h* of the lifting member 9 has an inside diameter that is larger than the outside diameter of the platen roller bearings 8, so that the lifting member 9 will not collide with the platen roller bearings 8 during the rotation of the platen roller 7.

The lifting member 9 furthermore has a spring attachment hole 9*g*, which is used to attach the other end of the extension coil spring 10, and a pressing portion 9*j* formed at a discharge direction end of the main portion 9*m*. As shown in FIG. 2, the pressing portion 9*j* of the lifting member 9 is disposed beneath a pressing plate 6*a* of the paper cassette 6.

The drive gear 11 is attached to the side surface 1*a* of the chassis 1. The cam portion 1*a* that engages the engaging portion 9*i* of the lifting member 9 is provided on the side surface 1*a* side of this drive gear 11. A circular component 11*b* and a concave component 11*c* are formed on this cam portion 11*a*.

As shown in FIG. 3, the drive gear 11 is provided with a large diameter gear component 11*d* and a small diameter gear component 11*e*. The large diameter gear component 11*d* of the drive gear 11 meshes with a small diameter gear component 13*a* of the intermediate gear 13. The small diameter gear component 1*e* of the drive gear 11, as shown in FIG. 1, meshes with the pressing member 19.

As shown in FIG. 3, the intermediate gear 13 is attached to the side surface 1*a* of the chassis 1. The pressing member 19 is attached to the support rod 17 and has the function of pressing the thermal head 20 against the platen roller 7. The ends of the support rod 17 are rotatably supported by the support rod bearings 18. The thermal head 20 pivots around a support shaft 20*a* and performs printing on paper 25 supplied as shown in FIG. 11.

As shown in FIG. 2, the pressing plate 6*a* is provided at a specific location of the paper cassette 6. This pressing plate 6*a* is formed to be pivotable around fulcrums 6*b*. Also, the pressing plate 6*a* is formed so as to press the paper 25 against the paper feed roller 2 when pushed up by the pressing portion 9*j* of the lifting member 9.

The paper feed roller 2 is disposed above the pressing plate 6*a* of the paper cassette 6. Also, the paper feed roller 2 is designed so as to convey the paper 25 in the paper feed direction (the direction of the arrow A in FIG. 2) when rotated. The paper feed roller 2 is positioned near the center of the paper feed roller shaft 3.

The two ends of the paper feed roller shaft 3 are rotatably supported by the paper feed roller bearings 5 attached to the side surface 1*a* and the side surface 1*b* of the chassis 1. The paper feed roller gear 4 is attached to the end of the paper feed roller shaft 3 on the side surface 1*a* side, so as not to be relatively unrotatable. As shown in FIG. 3, the intermediate gears 15 mesh with this paper feed roller gear 4. The plurality of intermediate gears 15 are disposed so as to mesh also with the motor 14.

Next, the manner in which paper 25 is supplied in the thermal transfer printer pertaining to this embodiment will be described through reference to FIGS. 2, 3, 10, and 11. First, as shown in FIG. 10, the drive force from the motor 12 (see FIG. 3) causes the intermediate gear 13 to rotate in the direction of the arrow E in FIGS. 10 and 11, and the drive gear 11 to rotate in the direction of the arrow F.

As a result, as shown in FIG. 10, the engaging portion 9*i* of the lifting member 9 shifts from a state of being in contact with the circular component 11*b* of the drive gear 11 shown in FIG. 10, to a state of being in contact with the concave component 11*c* of the drive gear 11 shown in FIG. 11. Accordingly, as shown in FIG.11, the lifting member 9 pivots in the direction of the arrow C shown in FIGS. 10 and 11 around the pivoting shaft point 9*a* with the biasing force of the extension coil spring 10. As a result, the pressing portion 9*j* of the lifting member 9 causes the paper 25 supported by the pressing plate 6*a* of the paper cassette 6 to be pressed against the paper feed roller 2.

Next, as shown in FIG. 3, the drive force of the motor 14 is transmitted through the plurality of intermediate gears 15 to the paper feed roller gear 4. As a result, the paper feed roller shaft 3 and the paper feed roller 2 rotate, so the paper 25 is conveyed in the direction of the arrow A shown in FIG. 2.

Next, the method for attaching the lifting member of the thermal transfer printer in this embodiment will be described through reference to FIG. 2 and FIGS. 5 to 9.

With this embodiment, first, as shown in FIGS. 5 and 6, the lifting member 9 is disposed above the bottom surface 1*c* of the chassis 1. As shown in FIG. 7, the lifting member 9 is then moved vertically downward (the direction of the arrow (1) in FIGS. 6 and 7) from a horizontal state, so that the pivoting shaft parts 9*a* and 9*b* of the lifting member 9 having the width W3 are fitted into the coupling part 1*k* of the coupling hole 1*i* and the coupling part 1*l* of the coupling hole 1*j*, respectively, each of which have the width W1 that is greater than the width W3. The resulting state is shown in FIG. 8.

Figure 8:
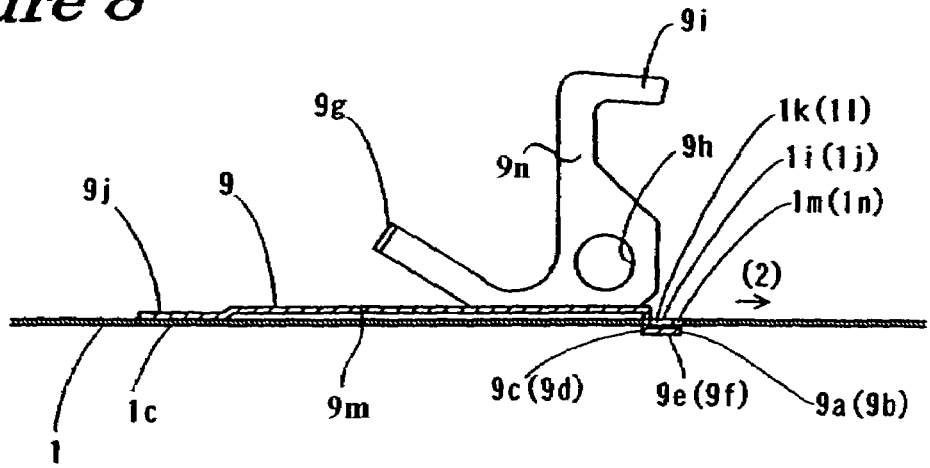
FIG. 8 is a schematic side view of the detailed structure of the lifting member of the thermal transfer printer pertaining to the embodiment shown in FIG. 1.

From the state shown in FIG. 8, the pivoting shaft parts 9*a* and 9*b* of the lifting member 9 are then moved in the direction of the arrow (2) (horizontally) until the shaft portions 9*c* and 9*d* reach the bottom surface 1*c* of the chassis 1. The pivoting shaft parts 9*a* and 9*b* are then moved from the coupling parts 1*k* and 1*l* in the direction of the arrow (3) shown in FIG. 6 (horizontally). As a result, the pivoting shaft parts 9*a* and 9*b* engage the support shaft parts 1*m* and 1*l*, which have the width W2 that is greater than the thickness t1 of the lifting member 9. At this point, the lifting member 9 is pivotably mounted in the coupling holes 1*i* and 1*j*.

Then, as shown in FIG. 9, the drive gear 11 is attached to the side surface 1*a* of the chassis 1 using the gear support shaft 22, the lock washer 23, and the washer 24. As a result, the engaging portion 9*i* of the lifting member 9 is put into the state shown in FIGS. 2 and 9, in which the engaging portion 9*i* is sandwiched in the widthwise direction between the drive gear 11 and the side surface 1*a* of the chassis 1. This completes the attachment of the lifting member 9.

With this embodiment, as discussed above, the pivoting shaft parts 9*a* and 9*b* are formed unitarily with the metal lifting member 9 as a one-piece member. In other words, fewer parts are required as compared with the case where the pivoting shafts are formed separately from the lifting member 9.

Also, because the shaft parts 9*c* and 9*d* and the retainer parts 9*e* and 9*f* are provided to the lifting member 9, the pivoting shaft parts 9*a* and 9*b* of the lifting member 9, the lifting member 9 can be prevented from coming off upward from the coupling holes 1*i* and 1*j* while the lifting member 9 is pivoting by the retainer parts 9*e* and 9*f*.

Furthermore, since the pivoting shaft parts 9*a* and 9*b* of the lifting member 9 are fitted into the bottom surface 1*c* of the chassis 1, and the coupling holes 1*i* and 1*j* that support the lifting member 9 so as to be pivotable around the shaft parts 9*c* and 9*d* of the pivoting shaft parts 9*a* and 9*b* are provided, fewer parts are required as compared with a case where a member for pivotably supporting the pivoting shaft parts 9*a* and 9*b* of the lifting member 9 is provided separately from the chassis 1.

Also, the pivoting shaft parts 9*a* and 9*b* of the lifting member 9 are fitted into the bottom surface 1*c* of the chassis 1, and the coupling holes 1*i* and 1*j* that support the lifting member 9 so as to be pivotable around the shaft parts 9*c* and 9*d* of the pivoting shaft parts 9*a* and 9*b* are provided. Therefore, unlike the case where support shaft parts that pivotably support the pivoting shaft parts 9*a* and 9*b* of the lifting member 9 are provided to the side surface 1*a* and the side surface 1*b* of the chassis 1, there is no need for the length of the lifting member 9 to be the same as the distance between the side surface 1*a* and side surface 1*b* of the chassis 1. Therefore, the length of the lifting member 9 can be shorter than the distance between the side surface 1*a* and side surface 1*b* of the chassis 1. This allows the lifting member 9 to be made smaller.

Also, since the pivoting shaft parts 9*a* and 9*b* of the lifting member 9 are fitted into the bottom surface 1*c* of the chassis 1, and the coupling holes 1*i* and 1*j* that support the lifting member 9 so as to be pivotable around the shaft parts 9*c* and 9*d* of the pivoting shaft parts 9*a* and 9*b* are provided, the lifting member 9 can be pivotably attached to the bottom surface 1*c* of the chassis by merely fitting the pivoting shaft parts 9*a* and 9*b* of the lifting member 9 into the coupling holes 1*i* and 1*j*. This allows the lifting member 9 to be assembled easily.

With this embodiment, the coupling holes 1*i* and 1*j* in the bottom surface 1*c* of the chassis 1 include slot-shaped coupling parts 1*k* and 1*l* and slot-shaped support shaft components 1*m* and 1*n*. The coupling parts 1*k* and 1*l* have a specific width W1, and the pivoting shaft parts 9*a* and 9*b* of the lifting member 9 are fitted into coupling parts 1*k* and 1*l*. The support shaft components 1*m* and 1*n* are formed so as to be linked to the coupling parts 1*k* and 1*l*, and have a width W2 that is narrower than the width W1 of the coupling parts 1*k* and 1*l*. The support shaft parts 1*m* and 1*n* are used for pivotably supporting the lifting member 9 around the pivoting shaft parts 9*a* and 9*b*. The pivoting shaft parts 9*a* and 9*b* of the lifting member 9 are inserted into the coupling parts 1*k* and 1*l* and then moved horizontally from the coupling parts 1*k* and 1*l* to the support shaft components 1*m* and 1*n*, so as to be pivotably mounted in the coupling holes 1*i* and 1*j*. Accordingly, the process of attaching the pivoting shaft parts 9*a* and 9*b* of the lifting member 9 into the coupling holes 1*i* and 1*j* is easier. Furthermore, the narrower support shaft parts 1*m* and 1*n* can easily support the pivoting shaft parts 9*a* and 9*b* of the lifting member 9 so as to be pivotable.

Also, with this embodiment, there is further provided the drive gear 11 having the cam portion 11*a* for pivoting the lifting member 9. The engaging portion 9*i* that engages with the cam portion 11*a* is formed unitarily with the lifting member 9. Furthermore, the engagement portion 9*i* of the lifting member 9 is sandwiched between the drive gear 11 and the first side surface 1*a* of the chassis 1 in the widthwise direction. Therefore, the pivoting shaft parts 9*a* and 9*b* of the lifting member 9 can be prevented from moving in the widthwise direction. Thus, the pivoting shaft parts 9*a* and 9*b* of the lifting member 9 can be prevented from coming off upward through the coupling holes 1*i* and 1*j*.

Also, with this embodiment, the pivoting shaft parts 9*a* and 9*b* are provided to the lifting member 9*a* specific distance apart. The bottom surface 1*c* of the chassis 1 is provided with the coupling hole 1*i* into which the pivoting shaft part 9*a* of the lifting member 9 is fitted and pivotably supported. The bottom surface 1*c* of the chassis 1 is also provided with the coupling hole 1*j* a specific distance apart from the coupling hole 1*i*, and into which the second pivoting shaft part 9*b* of the lifting member 9 is fitted and pivotably supported. In this manner, the lifting member 9 is pivotably supported by the two coupling holes 1*i* and 1*j*. Thus, the lifting member 9 can pivot stably.

The embodiments disclosed herein are merely examples in all respects, and should not be construed as limiting in nature. The scope of the present invention is given by the claims, and not by the above description of the embodiments. Furthermore, the present invention encompasses all modifications that are within the equivalent meaning and scope of the claims.

For instance, in the above embodiments, a thermal transfer printer is described as an example of an image forming apparatus, but the present invention is not limited to such construction. The present invention can be applied to an image forming apparatus other than a thermal transfer printer, such as an inkjet printer or a laser printer.

Also, in the above embodiments, the coupling parts 1*k*, 1*l* and the support shaft parts 1*m*, in of the coupling holes 1*i*, 1*j* that formed on the bottom surface 1*c* of the chassis 1 are formed in a slot-shape. However, the present invention is not limited to such construction. T the coupling part and the support shaft part of the coupling hole provided on the bottom surface of the chassis may instead be formed in a shape other than a slot-shape.

Figure 12:
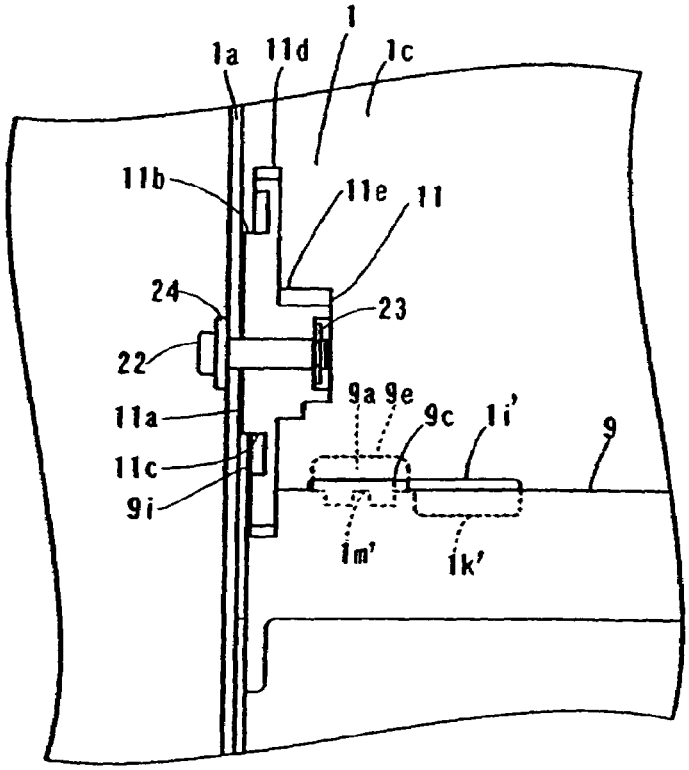
FIG. 12 is a partial schematic plan view of the detailed structure of the lifting member, the gear, and the chassis of the thermal transfer printer pertaining to an alternate embodiment.

For example, the support shaft parts 1*m*', 1*n*' may be formed so as to be partially wider as shown in FIG. 12, such that the areas around the support shaft parts 1*m*', 1*n*' can be strengthened.

Also, in the above embodiments, two pivoting shaft parts and two coupling holes are provided. However, the present invention is not limited to such construction. There may instead be just one pivoting shaft part and one coupling hole, or there may be three or more of each.

Figure 13:
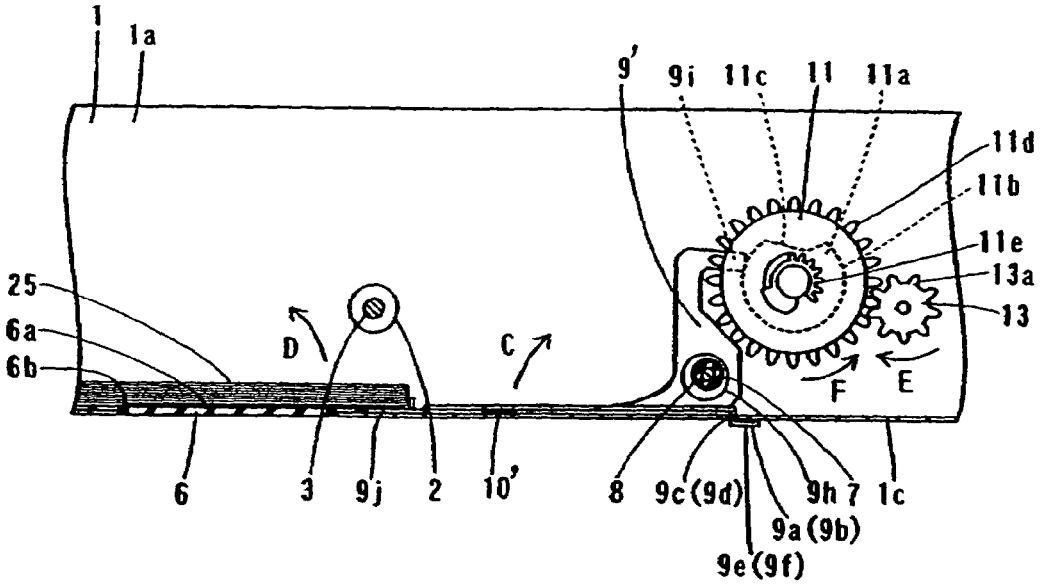
FIG. 13 is a schematic side view of the thermal transfer printer pertaining to a still another embodiment in a state when the engaging portion of the lifting member engages the circular portion of the cam component of the drive gear.
Figure 14:
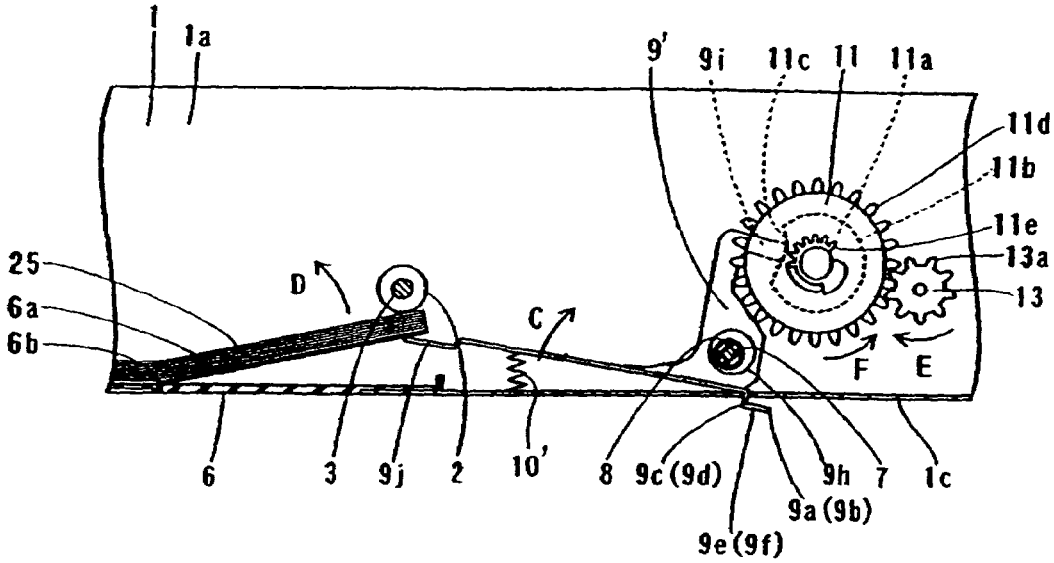
FIG. 14 is a schematic side view of the thermal transfer printer pertaining to the embodiment shown in FIG. 13 in a state when the engaging portion of the lifting member engages the concave portion of the cam component of the drive gear.
Figure 15:
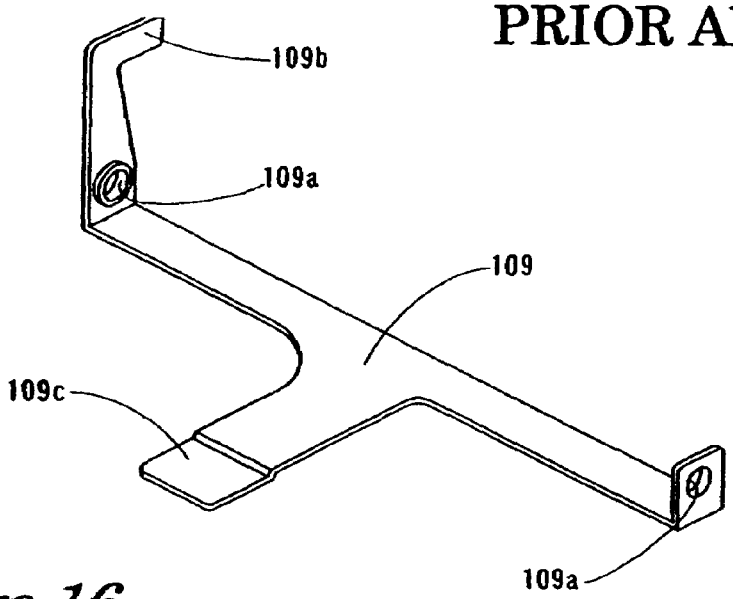
Figure 15 PRIOR ART
FIG. 15 is a perspective view of the lifting member of the conventional thermal transfer printer.
Figure 16:
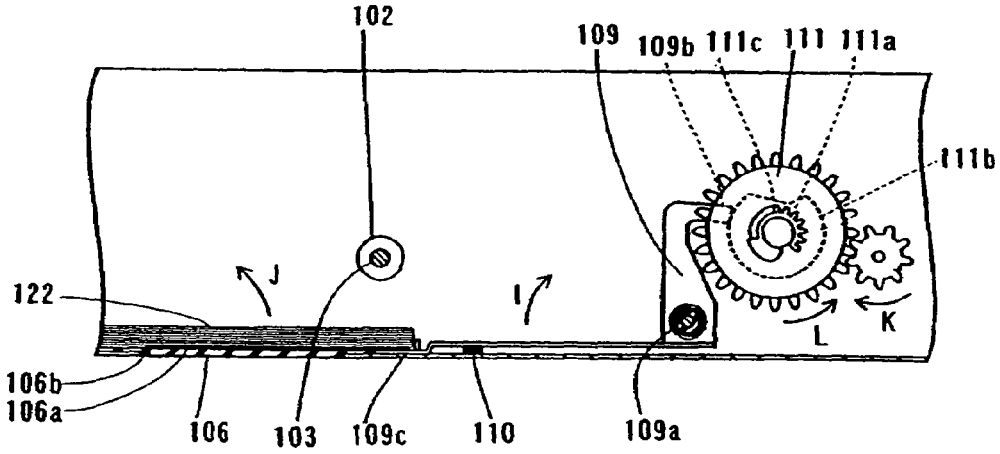
FIG. 16 is a schematic side view of the conventional thermal transfer printer in a state where the engaging portion of the lifting member engages the circular portion of the cam component.
Figure 17:
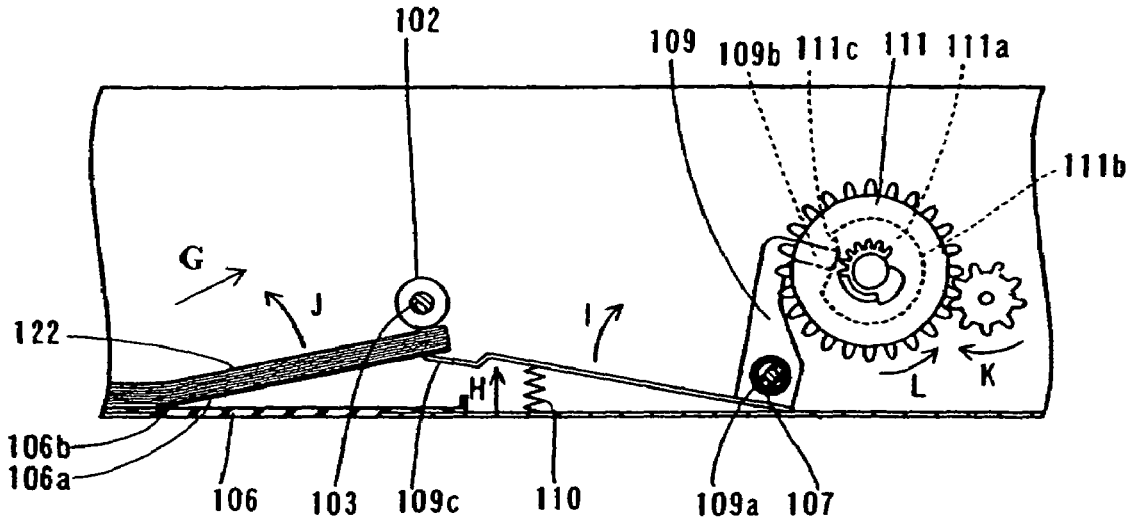
Figure 17 PRIOR ART
FIG. 17 is a schematic side view of the conventional thermal transfer printer in a state where the engaging portion of the lifting member engages the concave portion of the cam component.

Still furthermore, although the extension coil spring 10 is used in the above embodiment to pivot the lifting member 9 upward, the present invention is not limited to such construction. For example, as shown in FIGS. 13-14, the image forming apparatus of the present invention can have a compression coil spring 10' disposed on the bottom surface 1*c* beneath the lifting member 9' to bias the lifting member 9' upward. In this case, the lifting member 9' does not have a spring attachment hole. Also, there is no spring attachment hole in the side surface 1*a* of the chassis 1.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An image forming apparatus comprising:

a chassis having a first side surface, a second side surface, and a bottom surface that connects the first and the second side surfaces, the bottom surface having one of a first L-shaped projecting portion or a first coupling hole unitarily formed thereon;

a paper feed roller rotatably supported by the first and second side surfaces of the chassis to convey paper that is placed on a pressing plate;

a lifting member pivotally supported by the bottom surface of the chassis, and having a main portion and the other of the first coupling hole or the first L-shaped projecting portion unitarily formed on the main portion, the first L-shaped projecting portion being pivotally coupled to the first coupling hole, such that the lifting member is pivotally coupled to the bottom surface, the lifting member being further configured to lift the pressing plate upward toward the paper feed roller and having a narrower width in a direction perpendicular to a paper conveyance direction than a width of the pressing plate; and a biasing member for biasing the lifting member upward toward the paper feed roller.

2. An image forming apparatus comprising:

a chassis having a first side surface, a second side surface, and a bottom surface that connects the first and the second side surfaces, the bottom surface having one of a first L-shaped projecting portion or a first coupling hole unitarily formed thereon;

a paper feed roller rotatably supported by the first and second side surfaces of the chassis to convey paper;

a lifting member pivotally supported by the bottom surface of the chassis, and having a main portion and the other of the first coupling hole or the first L-shaped projecting portion unitarily formed on the main portion, the first L-shaped projecting portion being pivotally coupled to the first coupling hole, such that the lifting member is pivotally coupled to the bottom surface;

a biasing member for biasing the lifting member upward toward the paper feed roller; and the first coupling hole being an L-shaped hole having a first paper conveyance direction width and a second paper conveyance direction width that is narrower than the first paper conveyance direction width.

3. The image forming apparatus according to claim 2, wherein the first paper conveyance direction width of the first L-shaped coupling hole is wider than a paper conveyance direction width of the first L-shaped projecting portion of the lifting member.

4. The image forming apparatus according to claim 1, further comprising a motor;

a gear to which driving force of the motor is transmitted; and a cam portion that is relatively unrotatably attached to the gear, the lifting member having an engagement projection that engages the cam portion.

5. The image forming apparatus according to claim 4, wherein the gear is coupled to the first side surface of the chassis, and the engagement projection of the lifting member and the cam portion are sandwiched between the gear and the first side surface of the chassis.

6. The image forming apparatus according to claim 1, wherein the bottom surface has first and second coupling holes formed thereon, and the lifting member has first and second L-shaped projecting portions unitarily formed on the main portion, the second L-shaped projecting portion being pivotally coupled to the second L-shaped coupling hole of the bottom surface, such that the lifting member is pivotally coupled to the bottom surface.

7. The image forming apparatus according to claim 1, wherein the biasing member is an extension coil spring that is attached to one of the first and second side surfaces and the lifting member.

8. The image forming apparatus according to claim 1, wherein the biasing member is a compression coil spring that is attached to the bottom surface underneath the lifting member.

9. An image forming apparatus comprising a motor a gear to which driving force of the motor is transmitted;

a cam portion relatively unrotatably attached to the gear, a chassis having a first side surface, a second side surface, and a bottom surface that connects the first and the second side surfaces, the bottom surface having one of a first L-shared projecting portion or a first coupling hole unitarily formed thereon;

a paper feed roller rotatably supported by the first and second side surfaces of the chassis to convey paper;

a lifting member pivotally supported by the bottom surface of the chassis, and having a main portion, an engagement projection that engages the cam portion, and the other of the first coupling hole or the first L-shaped projecting portion unitarily formed on the main portion, the first L-shaped projecting portion being pivotally coupled to the first coupling hole, such that the lifting member is pivotally coupled to the bottom surface;

a biasing member biasing the lifting member upward toward the paper feed roller;

a thermal head pivotally supported by the first and second side surfaces of the chassis and configured to be pivoted by the motor; and a platen roller rotatably supported by the first and second side surfaces of the chassis opposite the thermal head, printing being configured to be performed on paper when the paper is pressed against the platen roller by the thermal head, the lifting member being configured to be lifted up when the motor drives the thermal head to be pressed against the platen roller.

10. An image forming apparatus comprising:

a chassis having a first side surface, a second side surface, and a bottom surface that connects the first and the second side surfaces, the bottom surface having first and second L-shaped coupling holes formed thereon, each of the first and second L-shaped coupling holes having a first paper conveyance direction width and a second paper conveyance direction width that is narrower than the first paper conveyance direction width;

a motor;

a gear to which driving force of the motor is transmitted, the gear being coupled to the first side surface of the chassis;

a cam portion relatively unrotatably attached to the gear, a paper feed roller rotatably supported by the first and second side surfaces of the chassis to convey paper;

a lifting member pivotally supported by the bottom surface of the chassis, and having a main portion and first and second L-shaped projecting portions unitarily formed on the main portion, the first and second L-shaped projecting portions being respectively pivotally coupled to the first and second L-shaped coupling holes of the bottom surface, such that the lifting member is pivotally coupled to the bottom surface, the lifting member having an engagement projection that engages the cam portion, the engagement projection and the cam portion being sandwiched between the gear and the first side surface of the chassis, the first paper conveyance direction width of the first and second L-shaped coupling holes being wider than a paper conveyance direction width of the first and second L-shaped projecting portions of the lifting member;

an extension coil spring biasing the lifting member upward toward the paper feed roller, the extension coil spring being attached to one of the first and second side surfaces and the lifting member;

a printer head pivotally supported by the first and second side surfaces of the chassis and configured to be pivoted by the motor; and a platen roller rotatably supported by the first and second side surfaces of the chassis opposite the printer head, printing being configured to be performed on paper when the paper is pressed against the platen roller by the printer head, the lifting member being configured to be lifted up when the motor drives the printer head to be pressed against the platen roller.

* * * * *